US005123590A

United States Patent [19]

Teele

[11] Patent Number: 5,123,590

[45] Date of Patent: Jun. 23, 1992

[54] MAIL DELIVERY INDICATOR FOR A MAILBOX

[76] Inventor: A. James Teele, 4015 Center St., Mims, Fla. 32754

[21] Appl. No.: 756,988

[22] Filed: Sep. 9, 1991

[51] Int. Cl.[5] ..... B65D 91/00

[52] U.S. Cl. ..... 232/35; 40/608; 116/173; 116/175

[58] Field of Search ..... 232/17, 34, 35, 37; 40/607, 608; 116/173, 174, 175

[56] References Cited

U.S. PATENT DOCUMENTS

| | | | |
|---|---|---|---|
| 429,214 | 6/1890 | Lanius | 116/175 |
| 755,143 | 3/1904 | Landers | 116/175 |
| 1,451,876 | 4/1923 | Jewett, Jr. | 232/35 |
| 1,672,134 | 6/1928 | Pitt et al. | 116/175 |
| 2,433,940 | 7/1945 | Weaver | 232/35 |
| 3,148,856 | 9/1965 | Orlando | 116/173 |
| 3,241,516 | 3/1966 | Hopkins | 116/173 |
| 3,482,543 | 9/1968 | Guidos | 116/132 |
| 3,596,631 | 8/1971 | Sutton | 232/35 |
| 4,711,391 | 12/1987 | Roge | 232/35 |
| 4,728,028 | 3/1988 | Barnes et al. | 232/35 |
| 4,756,472 | 7/1988 | Hammons | 232/35 |
| 4,913,342 | 4/1990 | Fluck | 232/35 |
| 4,953,783 | 9/1990 | Chambers | 232/35 |

*Primary Examiner*—Renee S. Luebke
*Assistant Examiner*—Michael J. Milano
*Attorney, Agent, or Firm*—James O. Harrell

[57] ABSTRACT

A mail delivery indicator which may be readily and easily mounted on the standard rural or cluster mailbox to signal when the mail has been delivered by the mail carrier. The mail delivery indicator comprises an elongated rod forming a flag staff with one of its ends connected to a coiled spring attached by a bracket to the right side of the mailbox. The other end of the flag staff is provided with a flag member and a latch element. The latch element serves the dual purpose of securing the flag to the flag staff and engaging a catch element on the mailbox door to set the flag staff in its horizontal nonsignaling position when the door is closed. When the door is opened by the mail carrier, the latch element releases from the catch element and the coiled spring causes flag staff to automatically swing to its vertical signaling position. The flag can be rotatably positioned on the flag staff to permit optimum viewing and is also provided with a specially designed offset portion which clears the catch element as the flag staff swings upwardly.

6 Claims, 1 Drawing Sheet

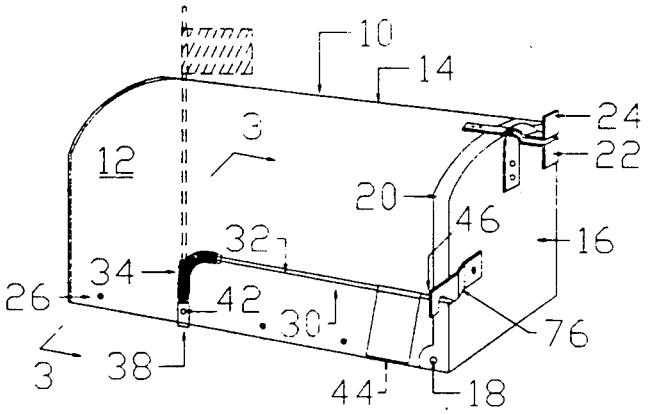
FIG. 1
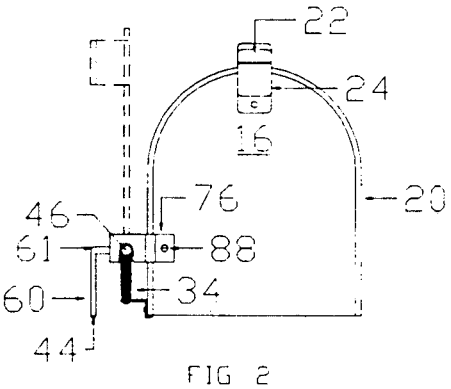
FIG. 2
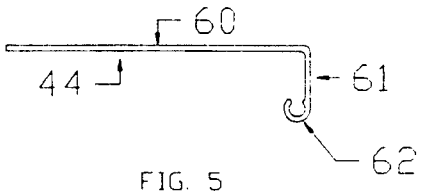
FIG. 5
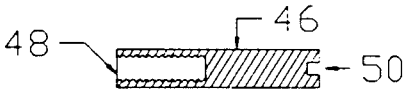
FIG. 6
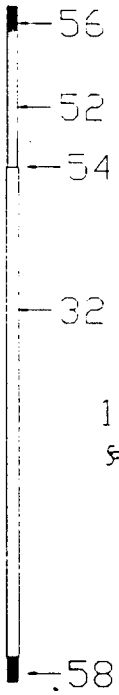
FIG. 4
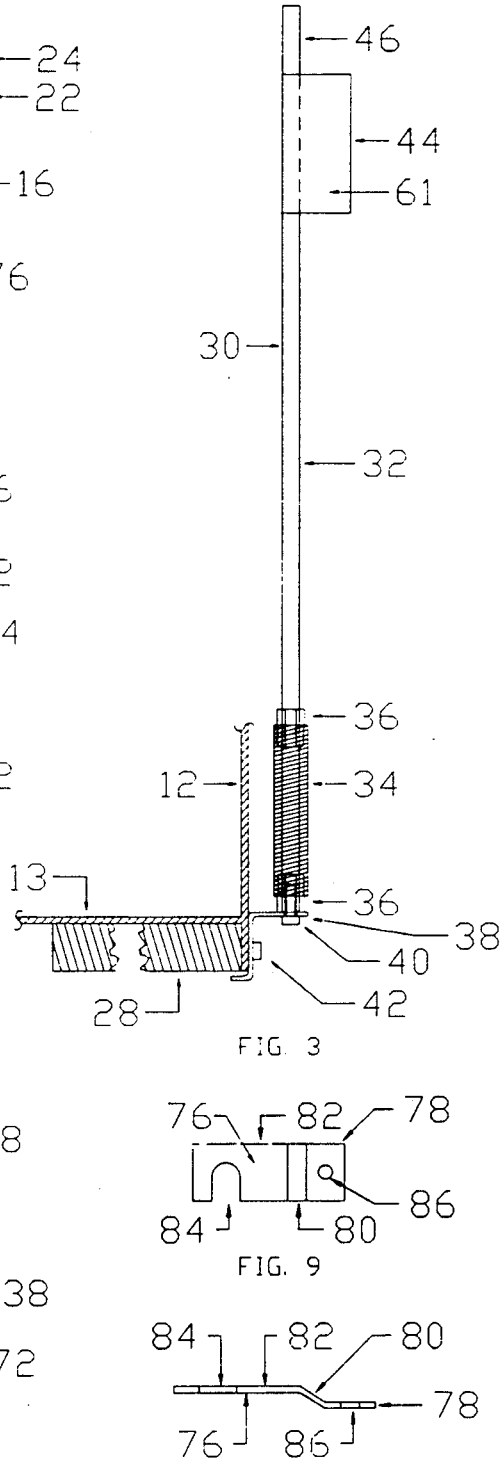
FIG. 3
FIG. 9
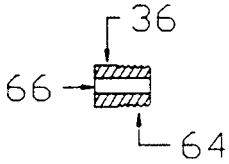
FIG. 7
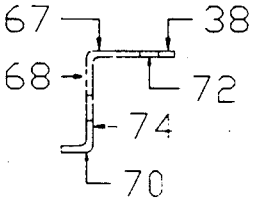
FIG. 8
FIG. 10

MAIL DELIVERY INDICATOR FOR A MAILBOX

BACKGROUND OF THE INVENTION

This invention relates in general to a mail indicator, and more particularly to an indicator which is attached to a standard rural or cluster mailbox for automatically signaling or indicating when the mail has been delivered by a mail carrier.

In rural and suburban areas, the mail carrier delivers mail to mailboxes located adjacent to the roads and streets which are usually a substantial distance from the houses. The standard rural type mailbox provides a pivotal flag on its left side which may be raised to indicate to the mail carrier that there is outgoing mail for him or her to pick up. Although the mail carrier normally lowers the flag after the mail is picked up, this does not serve very well as an indicator that incoming mail has been delivered because a person very infrequently places outgoing mail in the mailbox and raises the flag for pick up. Furthermore, if the flag had never been raised for the outgoing mail to be picked up in the first place, there would be nothing to indicate whether the mail carrier had already been along his or her route. The best solution to this problem is to provide the standard mailbox with an additional signaling or flag type of device which automatically indicates that the mail carrier has opened the mailbox door and deposited the mail. Such a delivery indicator is highly desirable because no one, particularly the elderly, enjoys making unnecessary trips to a far distant mailbox, especially through the cold, heat, rain, snow or other severe weather conditions.

Several different types of mail delivery indicators have been previously proposed but, for the most part, they have not been put to wide use by the general public because they are either unduly complex, not seen easily from a distance, or constructed of flimsy and unacceptable materials, such as plastic. In general, the following exemplary patents disclose these types of mail delivery signaling devices. U.S. Pat. No. 4,953,783, granted to Chambers and entitled "Mailbox Signal Device", discloses a flag which pivots to a vertical position underneath the mailbox when the door is opened.

U.S. Pat. No. 4,913,342, granted to Fluck and entitled "Street Mail Box Signal Device", discloses a flag pivotally attached to the mailbox door by linkage which move it to an upright position. U.S. Pat. No. 4,756,472, granted to Hammons and entitled "Mail Delivery Signaling Flag", discloses a pivotal flag with a weighted end which causes it to swing to a vertical position when released by opening of the mailbox door. U.S. Pat. No. 4,728,028, granted to Barnes and entitled "Delivery Signal Device For A Mailbox", discloses a flag mounted by a coil spring and having a cord normally holding the flag in a horizontal position but being released by opening of the mailbox door to permit it to move to a vertical position.

U.S. Pat. No. 3,482,543, granted to Guidos and entitled "Mail Box Signal Flag", discloses a flag mounted on one end of an elongated coil spring and the other end attached to the side of the mailbox. A catch is attached to the flag and normally engages a bracket secured to the mailbox door for holding the flag in a horizontal position. U.S. Pat. No. 2,433,940, granted to Weaver and entitled "Mailbox Signal", discloses a signal rod attached to the top of a mailbox by a coil spring at one of its ends and the other end engaging the mailbox door to normally hold the rod in a horizontal position.

While the above patents show pertinent mail delivery indicators, none are as reliable in operation nor sturdy in construction as the mail delivery indicator of applicant's invention. The advantages and improvements of applicant's invention over these prior mail delivery signaling devices will become more evident from the following specification and detail description of the drawings.

SUMMARY OF THE INVENTION

In accordance with the present invention, applicant's mail delivery indicator consists of a kit or attachment which may be readily and easily applied to a standard mailbox for indicating that mail has been delivered to the mailbox by the mail carrier. The mail delivery indicator comprises an elongated rod forming a flag staff having one end connected to a coil spring attached by a mounting bracket to the lower right side of the standard mailbox. The other end of the staff rod has a flag and a latch element mounted thereon. In addition to securing the flag to the staff rod, the latch element also engages a catch element on the mailbox door to normally holds the flag and staff rod in a lowered nonsignaling position when the mailbox door is closed. When the mail carrier opens the mailbox door to deposit the mail, the catch element mounted on the door automatically releases the latch element on the staff rod and the coil spring causes the flag to swing to a raised signaling position. The flag may be easily reset with only one hand by simply swinging the staff rod to its lowered horizontal position so that the latch element engages a bottom portion of the catch element when the mailbox door is closed.

One of the main objects of the present invention is to provide an improved mail delivery indicator which is so superior in quality and operation that it will be readily utilized by the general public.

Another important object of the present invention is to provide a mail delivery indicator which is not only sturdy and inexpensive but will last a long time, and is of relatively simple construction.

It is another object of the present invention to provide a mail delivery indicator which can be readily and easily attached to the standard mailbox without special tools or equipment.

Still another object of the present invention is to provide a mail delivery indicator which is constructed of material that can withstand all types of weather conditions and is noncorrosive.

Yet another object of the present invention is to provide a mail delivery indicator which is constructed in such a manner that it swings into its vertical signal position automatically without potential interference or injury to the mail carrier when he or she opens the mailbox door.

Still another object of the present invention is to provide a mail delivery indicator which is very reliable in operation and use, and can be easily seen from a distance.

Yet another important object of applicant's invention is to provide a mail delivery indicator that is made from separately manufactured parts which can be readily and easily assembled by an unskilled or handicapped person.

BRIEF DESCRIPTION OF THE DRAWINGS

FIG. 1 is a perspective view showing one form of a standard mailbox with the mail delivery indicator mounted thereon;

FIG. 2 a front elevation view showing the mail delivery indicator attached to the side of the mailbox with the flag member in its nonsignaling position;

FIG. 3 partial sectional view of the mailbox and mail delivery indicator taken generally along line 3—3 in FIG. 1;

FIG. 4 is an elevation view of the staff rod without the flag member mounted thereon;

FIG. 5 is a side elevation view of the flag member;

FIG. 6 is a sectional view of the latch element which is attachable to one end of the staff rod;

FIG. 7 is a sectional view of the threaded stud member insertable in each end of the coiled spring;

FIG. 8 is a side elevation view of the mounting bracket for attaching the mail delivery indicator to the side of the mailbox;

FIG. 9 is a front elevation view of the catch element securable to the mailbox door; and FIG. 10 is a side elevation view of the catch element showing an offset portion for clearing the raised flange on the mailbox door.

DETAILED DESCRIPTION OF THE INVENTION

The mail delivery indicator of the present invention is intended to be used with all kinds of standard types of mailboxes, whether singular or plural. In FIGS. 1-3, a conventional singular road or street mailbox, designated generally by reference number 10, is shown having side portions 12, bottom portion 13 and top portion 14. Access to the interior of the mailbox 10 is gained through a door 16 hinged to the side portions 12 by hinge pins 18. The top and side edges of the door 16 have an integral, raised flange 20 forming a seal around the open end of the mailbox 10 and thereby preventing rain water from entering therein. The door 16 is held in its closed position by a male bracket member 22 secured thereto and engaging a flexible, female bracket member 24 secured to the mailbox top 14. The bracket members 22 and 24 are secured in place with conventional rivets or other suitable securing means.

The mailbox 10 may be mounted on a standard wood or metal support stand which is not shown except for the horizontal wooden platform 28 in FIG. 3. As shown in FIG. 1, the bottom edges of side portions 12 of mailbox 10 have conventional pre-drilled holes 26. These holes 26 normally receive wood screws for attaching the mailbox 10 to the platform 28.

As shown in FIGS. 1-3, a mail delivery indicator, designated generally by reference number 30, is attached to the right side portion 12 of the mailbox 10 by utilizing one of the pre-drilled holes 26, as will be discussed in more detail hereinafter. The mail delivery indicator 30, as shown in FIGS. 1 and 2, consists of a staff rod 32 having its lower end mounted on one end of a hollow coiled spring 34 by a threaded stud member 36. The other end of the coiled spring 36 has another threaded stud 36 which is secured to a mounting bracket 38 with a wood screw 42. The wood screw 42 also extends through one of the standard pre-drilled holes 26 in the side portion 12 of mailbox 10. The upper end of the staff rod 32 has a signal flag member 44 attached thereto and is secured in place by a latch element 46. The latch element 46 will be discussed in more detail hereinafter.

In FIG. 4, the staff rod 32 has a reduced diameter portion 52 which forms a shoulder 54 for engaging and supporting the lower edge of the signal flag member 44. The outer end of the reduced diameter portion 52 and the lower end of the staff rod 32 have threads 56 and 58, respectively.

The signal flag member 44, as shown in FIGS. 2 and 5, has an offset portion 60 and a right-angled mounting portion 61. The outer end of the mounting portion 61 has an eyelet element 62 for slideably receiving the reduced diameter portion 52 of staff rod 32. In assembling the mail delivery indicator 30, the eyelet element 62 of the signal flag member 44 slides onto the reduced diameter portion 52 until the lower edge of the eyelet element 62 engages the shoulder 54. The signal flag member 44 is then held in place by the latch element 46 which can be screwed onto the threads 56 at the outer end of the the reduced diameter portion 52. The signal flag member 44 may be rotated on the reduced diameter portion 52 to position it at different angles for exposing the maximum amount of body or surface so that optimum viewing of the signal flag member 44 may be experienced at any distance location by the mail patron. The signal flag member 44 may also be left unpainted, painted with a highly visible paint, such as red enamel, or provided with a bright colored adhesive tape so that it can be seen from a far distance.

From FIGS. 1, 3 and 6, it can be seen that the latch element 46 serves a dual purpose, one of which as a means, to be discussed later, for holding the mail delivery indicator 30 in its nonsignaling position and the other as a means for securing the signal flag member 44 to the reduced diameter portion 52 of the staff rod 32. The latch element 46 has inner threads 48 adjacent one end and a slot 50 at the other end thereof. The inner threads 48 are adapted to mate with the threads 56 on the outer end of the reduced diameter portion 52. The slot 52 is for accommodating a screwdriver which may be used to screw the latch element 46 onto the staff rod 32.

In FIG. 7, the stud member 36 is shown with outer threads 64 on a portion of its external surface and also internal threads 66 extending through its center. The outer threads 64 permit the stud member 36 to be screwed into the hollow ends of the coiled spring 34. The internal threads 66 are designed to mate with the threads 58 on the lower end of the staff rod 32.

As shown in FIG. 8, the mounting bracket 38 has a horizontal portion 67, vertical portion 68 and lip portion 70. Holes 72 and 74 for accommodating bolt 40 and screw 42 are provided in the horizontal and vertical portions 67 and 68, respectively. The lip portion 70 extends underneath the bottom edge of the side portion 12 of the mailbox 10 to prevent the mounting bracket 38 from rotating.

FIGS. 9 and 10 show a catch element 76 having a mounting portion 78, an angled portion 80 and an offset portion 82. The angled portion is designed to extend the catch element 76 over the raised flange 20 on the mailbox door 16. At the outer end of the offset portion 82, an elongated open-end slot 84 is provided for receiving the outer surface of latch element 46. This open-end slot 84 permits the mail delivery indicator to be set in its nonsignaling position with the use of only one hand. The mounting portion 78 is provided with a hole 86 for receiving a mounting bolt 88 to secure the catch element 76 to the outer surface of the mailbox door 16. The mounting bolt 88 extends through hole 86 and then through a corresponding hole (not shown) in the door 16. This corresponding hole can be easily provided in the door 16 by the manufacturer or drilled therein when the mail delivery indicator 30 is installed on the mailbox. The provision of this hole constitutes the only modification that has to be made to the standard mailbox to accommodate the mail delivery indicator 30.

It is to be understood that the mail delivery indicator 30 may be used on any size mailbox and also on the conventional larger multiple or cluster types of mailboxes which are normally installed by the U.S. Post Office in apartment and other multi-residental projects. The only change necessary to use the mail delivery indicator 30 with these larger multiple or cluster mailboxes is a slight modification to the offset portion 80 of the catch element 76 which varies depending on the particular size and design of the mailbox.

SUMMARY OF OPERATION

Once the mail delivery indicator 30 has been installed on the mailbox 10, its operation for indicating when the mail carrier has delivery the mail is very simple. Before the mail carrier delivers the mail, the mail delivery indicator 30 is set in its horizontal nonsignaling position. To set the mail delivery indicator 30 in this nonsignaling position, the mailbox door 16 is placed in its closed position and then the staff rod 32 is swung by the mail patron using only one hand to a horizontal position via the coiled spring 34 and the latch element 46 on staff rod 32 is positioned in the elongated open end slot 84 of catch element 76. When the mail carrier opens the mailbox door 16, latch element 46 is released from the catch element 76 and the coiled spring causes the staff rod and signal flag member 44 to automatically swing to its vertical signaling position. To prevent the edge of the signal flag member 44 from striking the catch element 76 as the staff rod 32 swings to the vertical signaling position, the offset portion 60 is designed in such a way, as seen in FIG. 2, to completely clear the catch element 76. Without this important feature of the present invention, the signal flag member 44 could easily interfere with delivery of the mail, especially when the mailbox door 16 is opened slowly by the mail carrier. With the signal flag member 44 being in its vertical signaling position, the recipient of the mail will know immediately that the mail carrier has deposited mail in the mailbox 10. Of course, if the mail carrier does not open the mailbox door 16 and the mail delivery indicator 30 stays in the horizontal nonsignaling position, such would simply means that there was no mail for that particular day. Since the multiple or cluster mailboxes usually have rear doors which the mail carrier opens to deposit mail in the various boxes, the operation of the mail delivery indicator 30 when used with them is substantially the same as that for the singular rural types of mailbox.

From the foregoing description, it can be seen that the mail delivery indicator 30 of the present invention provides an inexpensive, sturdy and mechanically simple indicating device for signaling rural and suburban households that their mail has been delivered by the mail carrier. The entire mail delivery indicator 30 is normally constructed of noncorrosive material, such as aluminum, which is very resistant to damage that could be caused by the elements and other environmental conditions. Also, since the mail delivery indicator has relatively few simple parts, it can be easily assembled by those who may be handicapped or who have limited skills.

While one preferred embodiment of the invention has been described using specific terms, such description is for present illustrative purposes only. It is to be understood that changes and variations to such embodiment, including but not limited to the substitution of equivalent features or parts, and the reversal of various features thereof, may be practiced by those of ordinary skill in the art without departing from the spirit or scope of the following claims.

What is claimed is:

1. A mail delivery indicator adapted for use with a standard mailbox having side portions and a door pivotally mounted thereon, comprising:

a flag staff means consisting of an elongated rod said elongated rod having a first diameter portion and a second reduced diameter portion to form an integral shoulder thereon;

a spring mounting means attached to one end of said first diameter portion of said elongated rod;

said spring mounting means adapted to be attached to one of said side portions of said mailbox;

a flag means having an eyelet means slideably receiving said second reduced diameter portion and engaging said integral shoulder;

a latch means attached to one end of said second reduced diameter portion and engaging said eyelet means to secure said flag means on said second reduced diameter portion of said elongated rod;

said elongated rod, eyelet means and latch means having outer surfaces substantially flush with each other to form a continuous, smooth surface throughout the full length of said flag staff means;

a catch means adapted to be attached to said pivotally mounted door; and said latch means adapted to engage said catch means to hold said flag means and said flag staff means in a ; horizontal nonsignaling position when said door is closed and further be released from said catch means thereby causing said spring mounting means to move said flag means and flag staff means to a vertical signalling position when said door is opened.

2. The mail delivery indicator as set forth in claim 1 wherein said flag means further includes an offset portion adapted to clear said catch means when said pivotally mounted door is opened.

3. The mail delivery indicator as set forth in claim 1 wherein said latch means includes internal threads with external threads on said one end of said second reduced diameter portion.

4. The mail delivery indicator as set forth in claim 1 wherein said spring mounting means consist of a hollow coiled spring, stud means extending into each end of said hollow coiled spring and a bracket means adapted to be attached to said one side portion of said mailbox; one of said stud means secured to said bracket means and the other of said hollow means secured to said one end of said first diameter portion of said elongated rod.

5. The mail delivery indicator as set forth in claim 4 wherein each of said stud means includes both internal and external threads.

6. In combination with a standard mailbox including side portions and a door pivotally mounted thereon which is adapted to move between opened and closed positions, a mail delivery indicator for indicating when said door has been opened and mail deposited in said mailbox by a mail carrier, said mail delivery indicator comprising:

a mounting bracket means attached to one of said side portions of said mailbox;

a flag staff means having opposite ends;

a spring means attaching one of said opposite ends of said flag staff means to said mounting bracket means;

said spring means consisting of a hollow coiled spring having stud means inserted in each end thereof with one of said stud means secured to said mounting bracket and the other of said stud means secured to said one of said opposite ends of said flag staff means;

said spring means adapted to move said flag staff means from a horizontal nonsignaling position to a vertical signaling position;

a flag means having an offset portion and a mounting portion attached to said flag staff means;

a latch means attached to the other of said opposite ends of said staff means;

a catch means having opposite end members;

one of said opposite end members of said catch means attached to said pivotally mounted door; and the other of said opposite end members of said catch means extending beyond an edge of said pivotally mounted door and adapted to engage said latch means when said pivotally mounted door is in said closed position;

whereby when said pivotally mounted door is opened, said latch means releases from said catch means and said spring means causes said flag staff means to automatically and unobstructively move to said vertical signaling position with said offset portion of said flag means clearing said other end member of said catch means.

* * * * *